US008027836B2

(12) United States Patent
Baker et al.

(10) Patent No.: US 8,027,836 B2
(45) Date of Patent: Sep. 27, 2011

(54) PHONETIC DECODING AND CONCATENTIVE SPEECH SYNTHESIS

(75) Inventors: David Robert Baker, Winchester (GB); Mark Richard Barnard, Stockbridge (GB); Richard John Gadd, Eastleigh (GB); Eric William Janke, Winchester (GB)

(73) Assignee: Nuance Communications, Inc., Burlington, MA (US)

( * ) Notice: Subject to any disclaimer, the term of this patent is extended or adjusted under 35 U.S.C. 154(b) by 905 days.

(21) Appl. No.: 11/940,743

(22) Filed: Nov. 15, 2007

(65) Prior Publication Data

US 2008/0133241 A1 Jun. 5, 2008

(30) Foreign Application Priority Data

Nov. 30, 2006 (GB) ..... 0623915.6

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 7,013,277 | B2 * | 3/2006 | Minamino et al. | 704/257 |
| 7,181,391 | B1 * | 2/2007 | Jia et al. | 704/231 |
| 7,286,987 | B2 * | 10/2007 | Roy | 704/270 |
| 2004/0148161 | A1 | 7/2004 | Das et al. | |

* cited by examiner

*Primary Examiner* — Susan McFadden
(74) *Attorney, Agent, or Firm* — Wolf, Greenfield & Sacks, P.C.

(57) ABSTRACT

A speech processing system includes a multiplexer that receives speech data input as part of a conversation turn in a conversation session between two or more users where one user is a speaker and each of the other users is a listener in each conversation turn. A speech recognizing engine converts the speech data to an input string of acoustic data while a speech modifier forms an output string based on the input string by changing an item of acoustic data according to a rule. The system also includes a phoneme speech engine for converting the first output string of acoustic data including modified and unmodified data to speech data for output via the multiplexer to listeners during the conversation turn.

20 Claims, 2 Drawing Sheets

PHONETIC DECODING AND CONCATENTIVE SPEECH SYNTHESIS

BACKGROUND OF THE INVENTION

The present invention relates to speech processing and more particularly to a speech processing system using phonetic decoding and concatenative speech.

IT (Information Technology) developments now allow people to have voice conversations with each other on a global basis. Voice conversations between people in different geographies, even when nominally conducted in a common language (e.g., English), is complicated by the accents of people whose native language is different from the common language. Written communication is generally unaffected by these variations, but once people need to speak directly to each other, for example in call-center/helpdesk situations or conference calls, the difficulty in understanding each others' variants of the common language can make communication very difficult and frustrating.

Elocution lessons are hardly practicable for the whole population and would be extremely expensive.

Feeding the text output from an automatic speech recognizer (ASR) into a Text To Speech (TTS) engine is limited by the accuracy and vocabulary of the ASR and the lack of ability of the TTS system to reflect the speaking patterns of the subject.

BRIEF SUMMARY OF THE INVENTION

The present invention may be implemented as a speech processing system for receiving speech data from a speaker during a conversation turn in a conversation session that includes one or more listeners. A phoneme recognition engine converts received speech data into an input string of acoustic data. A phoneme modification engine changes at least one item of acoustic data in the input string according to one or more rules to form at least one output string of acoustic data. A phoneme speech engine converts each formed output string to output speech data for output to at least one listener.

The present invention may also be implemented as a method of processing speech. Speech data is received from a speaker during a conversation turn in a conversation session and converted to an input string of acoustic data. At least one item of acoustic data is changed according to one or more rules to form at least one output string of acoustic data. Each formed output string of acoustic data is converted to speech data for output to at least one listener.

The present invention may also be implemented as a computer program product for processing speech. The computer program product includes a computer usable media embodying computer usable program code. The embodied code includes code configured to receive speech data from a speaker during the conversation turn in the conversation session, code configured to convert the received speech data to an input string of acoustic data, code configured to change at least one item of the acoustic data according to one or more rules to form at least one output string of acoustic data, and code configured to convert each formed output string to output speech data for output to a listener.

DETAILED DESCRIPTION OF THE INVENTION

Figure 1:
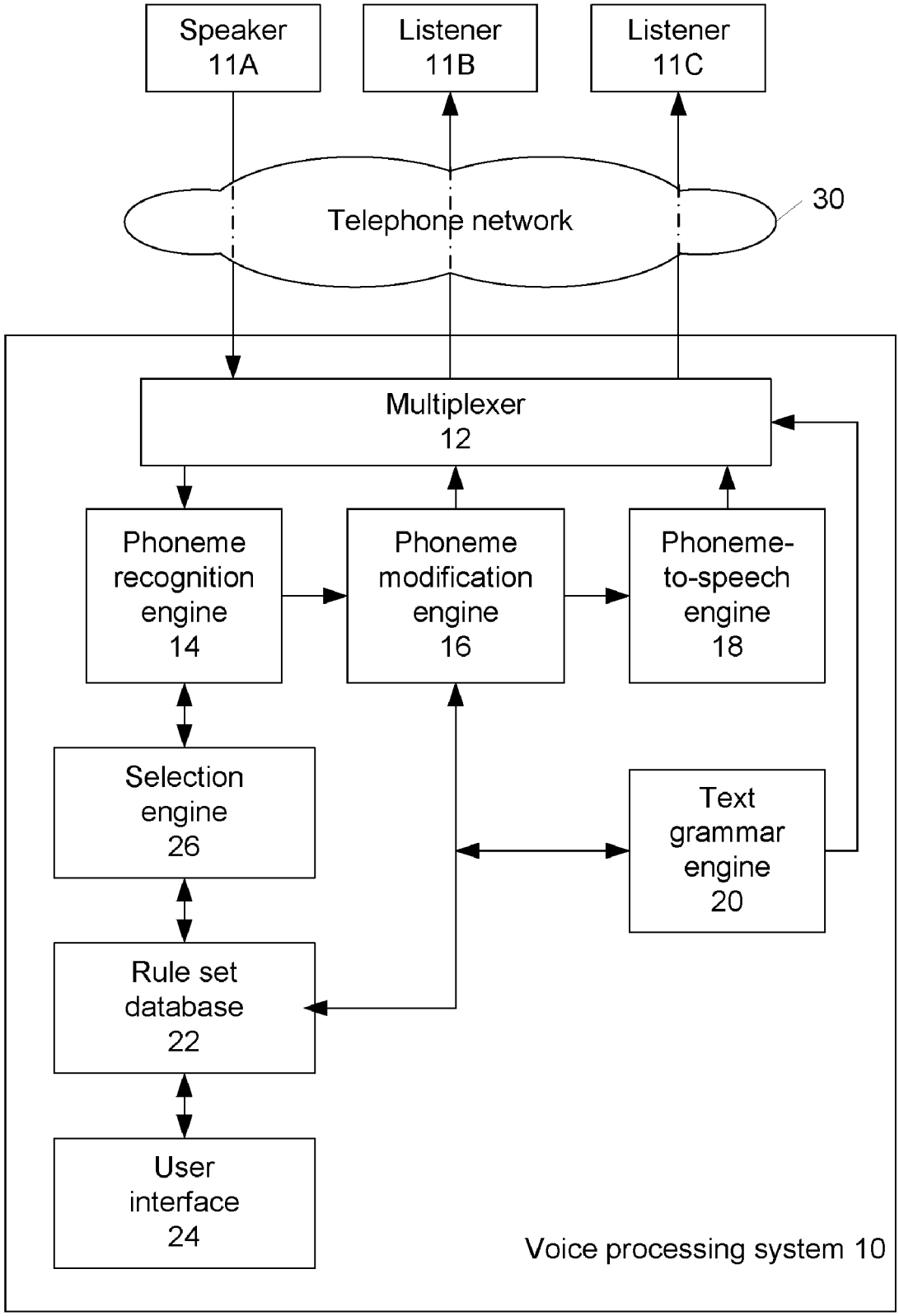
FIG. 1 is a schematic of an embodiment of a voice processing system according to the present invention.

As will be appreciated by one skilled in the art, the present invention may be embodied as a method, system, or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, RF, etc.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

FIG. 1 depicts a speech processing system 10 connected to three users 11A, 11B and 11C over a telephone network 30. The telephone network itself will not be described as it may be conventional in nature, using conventional telephony technologies or even Voice over IP (VoIP) technologies. The speech processing system 10 includes a multiplexer 12; a phoneme recognition engine 14; a phoneme modification engine 16; a phoneme-to-speech engine 18; a text grammar engine 20; a rule set database 22; a user interface 24; and a selection engine 26.

The multiplexer 12 receives speech data input as part of a conversation turn in a conversation session between two or more users where one user is a speaker and the other users are listeners in each conversation turn. The users who act as the speaker and as the listeners may, of course, change from one conversation turn to the next. User 11A is shown providing an input to the multiplexer 12, which splits the input into two outputs for users 11B and 11C. User 11A speaks into a microphone, typically in the telephone handset, which passes speech data in the form of audio signals to multiplexer 12.

The phoneme recognition engine 14 converts the speech data to an input string of acoustic data. The phoneme recognition engine 14 time labels the input audio stream phonemes and provides corresponding energy, pitch and duration information. This stream is fed into the phoneme-to-speech engine 18 via the phoneme modification engine 16. The system allows speakers to train the phoneme recognition engine 14 to maximize recognition accuracy.

The phoneme modification engine 16 forms one or more output strings based on the input string by changing acoustic data according to rules. The phoneme modification engine 16 initially forms an intermediate string based on the input string by changing acoustic data according to input rules associated with the speaker. In one embodiment the system uses a combination of text recognition and pure phoneme recognition to determine the best phonetic sequence to feed to the phoneme modification engine 16. The phoneme modification engine 16 sends the intermediate string to the text grammar engine 20 and receives a corrected intermediate string back after the text grammar engine has corrected text errors. Output strings for each listener are then formed from the corrected intermediate string by changing acoustic data according to output rules associated with each listener. The output strings are then sent to the phoneme-to-speech engine 18.

The phoneme-to-speech engine 18 converts one or more output strings of modified and unmodified acoustic data to respective speech data streams for output via the multiplexer 12 to one or more listeners through the telephone network 30. The phoneme-to-speech engine 18 can be the back-end of a conventional TTS system and bypasses the normal front-end generation of phoneme-id and duration, pitch contour and energy prediction. The phoneme-to-speech engine 18 can then simply use the input from the phoneme recognition engine directly to synthesize, in a more standard voice, the words of the speaker, while maintaining the speaking style by keeping constant the same pitch, energy and other acoustic data.

In one embodiment, the voice used in the phoneme-to-speech engine 18 is matched to the voice of the speaker. However, it would also be possible to transform a speaker's characteristics, particularly pitch, to match another voice in the repertoire, for instance, if it was desired to make the speaker's voice distinctive. In another embodiment an extra filter is applied to the phoneme string to produce further normalization. This filtering could be under control of the listener, speaker, or an autonomic optimizer.

In one embodiment, the text grammar engine 20 corrects the phonemes in the intermediate string by statistically matching the acoustic data against word or word sequence probabilities. The language model and vocabulary of the text grammar engine 20 component of the recognizer can also be supplemented with topic-specific text probabilities. The text grammar engine also applies text-based weighting to normalize pronunciation variations from the speaker. However, this does not preclude the user from saying words that are unknown to the text grammar engine since the text-based weighting is performed after the speech is modified for the speaker. The weighting given to text versus pure phoneme recognition can be adjusted to vary the amount of normalization.

In another embodiment, the text grammar engine 20 feeds equivalent text strings to the users via the multiplexer 12. The equivalent text strings have the same time stamp as the phoneme strings so that user clients can display the text and hear the speech at the same time.

The rule set database 22 stores the input and output rule sets associated with one or more classes of users. Each input and output rule set is associated with the one or more listeners. Each of the rules in an input rule set for a user is applied to the input phoneme string when that user is a speaker. Each of the rules in an output rule set for a user is applied to the intermediate phoneme string to form an output phoneme string when the user is a listener. The input and output rule sets can be different rule sets or a single set of rules, for instance, a mapping of rules can be applied in one direction for input strings and applied in the opposite direction for output strings.

The user interface 24 allows a user to select which rule set applies to which user.

The selection engine 26 samples speech data of each user and matches the sampled speech data to an input and an output rule set.

Figure 2:
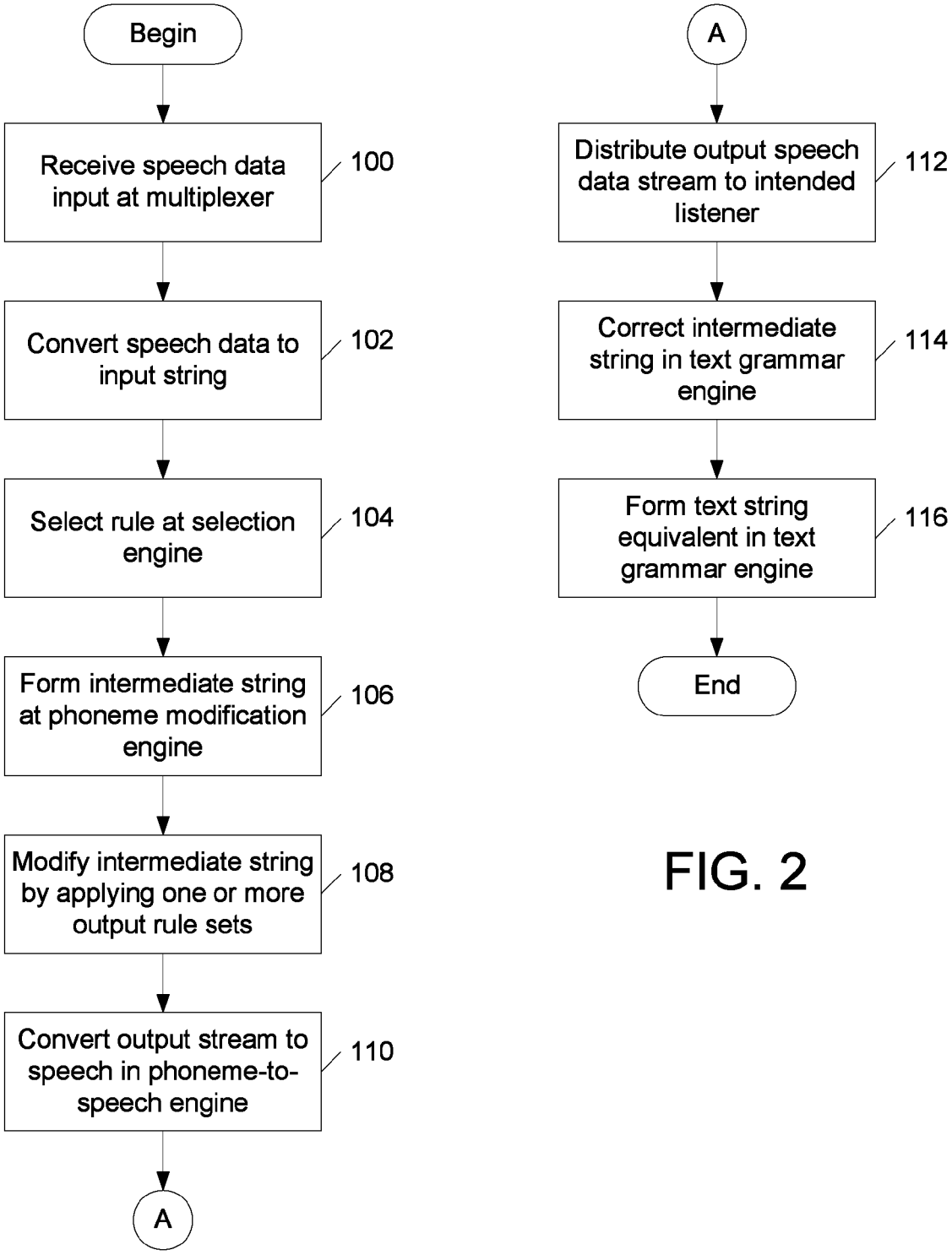
FIG. 2 is a schematic of an embodiment of a voice processing method according to the present invention.

Referring to FIG. 2 a method of an embodiment of the present invention will now be described.

In step 100, speech data input is received by multiplexer 12 as part of a conversation turn in a conversation session between users where one user is speaker 11A and the other users are listeners 11B and 11C in a particular conversation turn. Multiplexer 12 transfers the speech data to phoneme recognition engine 14.

In step 102, phoneme recognition engine 14 converts the speech data into an input string of acoustic data and passes the input string to phoneme modification engine 16 and selection engine 26.

In step 104, selection engine 26 selects rule sets by sampling the input string and matching the sampled speech data to a rule set stored in rule set database 22. The rule set may also be selected via a user interface 24.

In step 106, the phoneme modification engine forms an intermediate string based on the input string by changing one or more items of acoustic data according to selected input rules. The intermediate string is passed to the text grammar engine 20.

In step 108, the text grammar engine 20 corrects the intermediate string for spelling by statistically matching the acoustic data against a grammar of expected words.

In step 110, the text grammar engine 20 forms a text string equivalent of the corrected intermediate string. In step 111, the text string equivalent is passed to the multiplexer 12 and the corrected intermediate string is passed back to the phoneme modification engine 16.

In step 112, the phoneme modification engine 16 modifies the intermediate string by applying one or more output rule sets and forming one or more output strings. If no output rule set has been selected for a particular user, e.g. by the selection engine 26 in a previous step, then no modification of the intermediate string occurs. However, if an output rule set has already been identified for a user, then this rule set is applied when the user is a listener. A rule set may be used to create a unique speaker voice so that each speaker in a group conversation session is distinctive. This step is especially useful for three or more speakers because the natural unique voice of each user can be lost using the same phoneme database even if the remaining acoustic data is the same. One or more output strings are sent to the phoneme-to-speech engine 18.

In step 114, the phoneme-to-speech engine 18 converts the output strings of acoustic data, including modified and unmodified data, to speech data streams for the multiplexer 12.

In step 116, the multiplexer 12 distributes each speech data stream to the intended listener. At the same time the multiplexer distributes the respective text output received from the text grammar engine 20.

As an example, three users are having a conversation. The first and second users have an accent that causes them to pronounce the word "this" phonetically as "zis". A first user says phonetically "Can you do zis?" and the phoneme recognition engine 14 recognizes an input phoneme string "Can you do zis?". The phoneme modification engine identifies an input rule for the first user and second user so that when an input string from the first or second user contains the phonemes "zis" then the phonemes should be modified to "this". Therefore, the input string is modified so that the intermediate string is phonetically "can you do this?" Conversely, the phoneme modification engine identifies an output rule so that when the an intermediate string contains the phonetic "this", then the output string for the first or second user should have the phonemes modified to "zis". In this example, then the output string for the second user is modified back to the phonetic "Can you do zis?" while the intermediate string and the output sting for the third user are the same. The phoneme to speech engine then converts the output strings using the same voice and there is no discontinuity in speech output between the modified and the unmodified phonemes.

While it is understood that the process software may be deployed by manually loading directly in the client, server and proxy computers via loading a storage medium such as a CD, DVD, etc., the process software may also be automatically or semi-automatically deployed into a computer system by sending the process software to a central server or a group of central servers. The process software is then downloaded into the client computers that will execute the process software. Alternatively the process software is sent directly to the client system via e-mail. The process software is then either detached to a directory or loaded into a directory by a button on the e-mail that executes a program that detaches the process software into a directory. Another alternative is to send the process software directly to a directory on the client computer hard drive. When there are proxy servers, the process will, select the proxy server code, determine on which computers to place the proxy servers' code, transmit the proxy server code, then install the proxy server code on the proxy computer. The process software will be transmitted to the proxy server then stored on the proxy server.

The process software is shared, simultaneously serving multiple customers in a flexible, automated fashion. It is standardized, requiring little customization and it is scalable, providing capacity on demand in a pay-as-you-go model. The process software can be stored on a shared file system accessible from one or more servers. The process software is executed via transactions that contain data and server processing requests that use CPU units on the accessed server.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to preferred embodiments thereof, it will be apparent that modifications and variations are possible without departing from the scope of the invention defined in the appended claims.

What is claimed is:

1. A speech processing system for receiving speech data based on speech from a speaker during a conversation turn in a conversation session, said speech processing system comprising:

a phoneme recognition engine configured to convert the received speech data to an input string of acoustic data using at least one processor;

a phoneme modification engine configured to change at least one item of acoustic data in said input string according to one or more rules to form at least one output string of acoustic data, wherein the one or more rules comprise a user rule associated with a user in the conversation session, and wherein the user is selected from the group consisting of the speaker and at least one listener; and a phoneme speech engine configured to convert the at least one output string of acoustic data to output speech data for output to the at least one listener.

2. The speech processing system according to claim 1, wherein:

the user rule is an input rule associated with the speaker, and said phoneme modification engine is further configured to form an intermediate string from the input string of acoustic data according to the input rule.

3. The speech processing system according to claim 2 further comprising a grammar engine configured to receive the intermediate string, to statistically match acoustic data in the intermediate string against a set of expected words, and to make corrections in the intermediate string based on the results of the statistical matching.

4. The speech processing system according to claim 1 further comprising a selection engine configured to sample the speech data of the speaker and to select the one or more rules based on the results of the sampling.

5. The speech processing system according to claim 1 further comprising a rule set database for storing input and output rules associated with one or more classes of speakers and listeners.

6. The speech processing system according to claim 1 further comprising a speech-to-text engine for performing speech-to-text conversion on speech data.

7. The speech processing system according to claim 1, wherein:

the user rule is an output rule associated with the at least one listener, and said phoneme modification engine is further configured to form at least one output string of acoustic data according to the output rule.

8. A method of processing speech, the method comprising:

receiving speech data based on speech from a speaker during a conversation turn in a conversation session;

converting the received speech data to an input string of acoustic data using at least one processor;

changing at least one item of acoustic data in said input string according to one or more rules to form at least one output string of acoustic data, wherein the one or more rules comprise a user rule associated with a user in the conversation session, and wherein the user is selected from the group consisting of the speaker and at least one listener; and converting each formed output string of acoustic data to output speech data for output to the at least one listener.

9. The method of processing speech according to claim 8, wherein the user rule is an input rule associated with the speaker, the method further comprising:

forming an intermediate string from the input string of acoustic data according to the input rule.

10. The method of processing speech according to claim 9 further comprising:

receiving the intermediate string; and statistically matching acoustic data in the received intermediate string against a set of expected words; and making corrections in the intermediate string based on the results of the statistical matching.

11. The method of processing speech according to claim 8 further comprising:

sampling the speech data for one or more speakers; and selecting the one or more rules based on the results of the sampling.

12. The method of processing speech according to claim 8 further comprising storing input and output rules associated with one or more classes of speakers and listeners in a rule set database.

13. The method of processing speech according to claim 8 further comprising performing speech-to-text conversion of the output speech data.

14. The method of processing speech according to claim 8, wherein the user rule is an output rule associated with the at least one listener, the method further comprising:

forming at least one output string of acoustic data according to the output rule.

15. A computer usable non-transitory storage medium storing computer usable program code that, when executed by a processor, performs a method comprising:

receiving speech data based on speech from a speaker during a conversation turn in a conversation session;

converting the received speech data to an input string of acoustic data;

changing at least one item of acoustic data in said input string according to one or more rules to form at least one output string of acoustic data, wherein the one or more rules comprise a user rule associated with a user in the conversation session, and wherein the user is selected from the group consisting of the speaker and at least one listener; and converting each formed output string of acoustic data to output speech data for output to the at least one listener.

16. The computer usable non-transitory storage medium according to claim 15, wherein the user rule is an input rule associated with the speaker, the method further comprises:

forming an intermediate string from the input string of acoustic data according to the input rule.

17. The computer usable non-transitory storage medium according to claim 16, the method further comprises:

receive receiving the intermediate string;

statistically matching acoustic data in the received intermediate string against expected words; and making corrections in the intermediate string based on the results of the statistical matching.

18. The computer usable storage medium according to claim 15, the method further comprises:

sampling the speech data for one or more speakers; and selecting one or more rules based on the results of the sampling.

19. The computer usable storage medium according to claim 15, the method further comprises:

storing input and output rules associated with one or more classes of speakers and listeners in a rule set database.

20. The computer usable non-transitory storage medium according to claim 15, wherein the user rule is an output rule associated with the at least one listener, and wherein the method further comprises:

forming at least one output string of acoustic data according to the output rule.

* * * * *

UNITED STATES PATENT AND TRADEMARK OFFICE

CERTIFICATE OF CORRECTION

PATENT NO. : 8,027,836 B2
APPLICATION NO. : 11/940743
DATED : September 27, 2011
INVENTOR(S) : David Robert Baker et al.

It is certified that error appears in the above-identified patent and that said Letters Patent is hereby corrected as shown below:

In the Claims:

At column 8, claim 17, line 65, please change "receive receiving the intermediate string" to -- receiving the intermediate string --.

Signed and Sealed this
Thirteenth Day of March, 2012

David J. Kappos

David J. Kappos
*Director of the United States Patent and Trademark Office*